US011932820B2

(12) United States Patent
Monden et al.

(10) Patent No.: US 11,932,820 B2
(45) **Date of Patent: *Mar. 19, 2024**

(54) LUBRICATING OIL COMPOSITION AND METHOD FOR PRODUCING LUBRICATING OIL COMPOSITION

(71) Applicants: RESONAC CORPORATION, Tokyo (JP); MITSUBISHI CORPORATION, Tokyo (JP)

(72) Inventors: Ryuji Monden, Tokyo (JP); Kunio Kondo, Tokyo (JP)

(73) Assignees: Resonac Corporation, Tokyo (JP); MITSUBISHI CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/605,320

(22) PCT Filed: Apr. 23, 2020

(86) PCT No.: PCT/JP2020/017424

§ 371 (c)(1),
(2) Date: Oct. 21, 2021

(87) PCT Pub. No.: WO2020/218392

PCT Pub. Date: Oct. 29, 2020

(65) Prior Publication Data

US 2022/0186136 A1 Jun. 16, 2022

(30) Foreign Application Priority Data

Apr. 24, 2019 (JP) ..... 2019-083393

(51) Int. Cl.
*C10M 125/02* (2006.01)
*C10M 101/02* (2006.01)
(Continued)

(52) U.S. Cl.
CPC ..... *C10M 125/02* (2013.01); *C10M 101/02* (2013.01); *C10M 177/00* (2013.01);
(Continued)

(58) Field of Classification Search
CPC ..... C10M 125/02; C10M 101/02; C10M 177/00; C10M 2201/041;
(Continued)

(56) References Cited

U.S. PATENT DOCUMENTS 5,292,444 A 3/1994 Patil et al.
5,462,680 A 10/1995 Brois et al.
(Continued)

FOREIGN PATENT DOCUMENTS

CN 1441854 A 9/2003
CN 101155902 A 4/2008
(Continued)

OTHER PUBLICATIONS

Xuefeng Li, et al., "Fabrication and atomic force microscopy/friction force microscopy (AFM/FFM) studies of polyacrylamide-carbon nanotubes (PAM-CNTs) copolymer thin films", Materials Chemistry and Physics, vol. 88, Issue 1, Dec. 31, 2004, pp. 53-58 (6 pages total).
(Continued)

*Primary Examiner* — Ellen M Mcavoy
(74) *Attorney, Agent, or Firm* — Sughrue Mion, PLLC

(57) ABSTRACT

A method for producing a lubricating oil composition of the present embodiment includes an irradiation step of irradiating a fullerene solution in which fullerenes are dissolved in a base oil with radiation, in which the above-described radiation is ultraviolet light or ionizing radiation.

16 Claims, 1 Drawing Sheet

(51) Int. Cl.
*C10M 177/00* (2006.01)
*C10N 70/00* (2006.01)

(52) U.S. Cl.
CPC ..... *C10M 2201/041* (2013.01); *C10M 2203/1006* (2013.01); *C10N 2070/00* (2013.01)

(58) Field of Classification Search
CPC ..... C10M 2203/1006; C10N 2070/00; C10N 2020/06; C10N 2030/06
See application file for complete search history.

(56) References Cited

U.S. PATENT DOCUMENTS

| | | | | |
|---|---|---|---|---|
| 5,503,643 | A * | 4/1996 | Schriver | C10M 127/02 44/281 |
| 8,883,124 | B2 * | 11/2014 | Krishna | A61B 5/0095 977/734 |
| 11,214,749 | B2 * | 1/2022 | Monden | C10M 125/02 |
| 2002/0031615 | A1 | 3/2002 | Dykes et al. | |
| 2014/0312281 | A1 | 10/2014 | Jackson et al. | |
| 2015/0162044 | A1 | 6/2015 | Hanawa et al. | |
| 2016/0160148 | A1 | 6/2016 | Rai | |
| 2019/0032971 | A1 | 1/2019 | Ishida et al. | |
| 2020/0194677 | A1 | 6/2020 | Richter et al. | |
| 2020/0299601 | A1 | 9/2020 | Horie et al. | |
| 2020/0339904 | A1 | 10/2020 | Monden et al. | |
| 2021/0222083 | A1 | 7/2021 | Monden et al. | |
| 2021/0253968 | A1 * | 8/2021 | Kato | G11B 5/7257 |
| 2021/0371763 | A1 | 12/2021 | Monden et al. | |
| 2021/0371769 | A1 * | 12/2021 | Monden | C10M 169/04 |
| 2022/0220409 | A1 * | 7/2022 | Monden | C10M 169/04 |
| 2022/0228084 | A1 * | 7/2022 | Monden | C10M 125/02 |

FOREIGN PATENT DOCUMENTS

| | | | | |
|---|---|---|---|---|
| CN | 104762122 | A | 7/2015 | |
| CN | 105523924 | A | 4/2016 | |
| CN | 108865347 | A | 11/2018 | |
| EP | 0 544 513 | A1 * | 6/1991 | C08K 3/04 |
| EP | 3702435 | A1 | 9/2020 | |
| JP | 5-116922 | A | 5/1993 | |
| JP | 5-254815 | A | 10/1993 | |
| JP | 5-254989 | A | 10/1993 | |
| JP | 9-74216 | A | 3/1997 | |
| JP | 10-140169 | A | 5/1998 | |
| JP | 11-515053 | A | 12/1999 | |
| JP | 2004-231739 | A | 8/2004 | |
| JP | 2005-089667 | A | 4/2005 | |
| JP | 2005-154755 | A | 6/2005 | |
| JP | 2005-336309 | A | 12/2005 | |
| JP | 2007-86774 | A | 4/2007 | |
| JP | 2008-266501 | A | 11/2008 | |
| JP | 2017-88757 | A | 5/2017 | |
| KR | 10-2014-0103523 | A | 8/2014 | |
| WO | 97/16510 | A1 | 5/1997 | |
| WO | 2014/126315 | A1 | 8/2014 | |
| WO | 2015/192075 | A1 | 12/2015 | |
| WO | 2017/141825 | A1 | 8/2017 | |
| WO | 2019/004275 | A1 | 1/2019 | |
| WO | WO-2019082917 | A1 * | 5/2019 | C10M 125/02 |

OTHER PUBLICATIONS

A. Nigam, et al., "Lattice-type Polymers from an Adduct of [60]Fullerene and 2-Methylaziridine", Journal of the Chemical Society-Chemical Communications, vol. 15, Dec. 31, 1995, pp. 1547-1548 (2 pages total).
Wenchao Guan et al., "Preliminary study on synthesis and lubrication mechanism of polyhydroxyfullerene derivatives", 1998 China Materials Seminar, Dec. 31, 1998, pp. 191-194 (4 pages total).
Office Action dated Mar. 21, 2022 from the China National Intellectual Property Administration in CN Application No. 202080030347.4.
International Search Report for PCT/JP2020/017424, dated Jul. 21, 2020.
Office Action dated Dec. 21, 2022 in U.S. Appl. No. 17/605,282.
International Search Report for PCT/JP2020/017413, dated Jul. 21, 2020.
Office Action dated Mar. 22, 2022 issued by the Chinese Patent Office in Chinese Application No. 202080030403.4.
"Vacuum Technology-Vocabulary-Part 1:General terms", JIS Z8126-1:1999 (13 pages total).
International Search Report for PCT/JP2020/017423, dated Jul. 14, 2020.

* cited by examiner

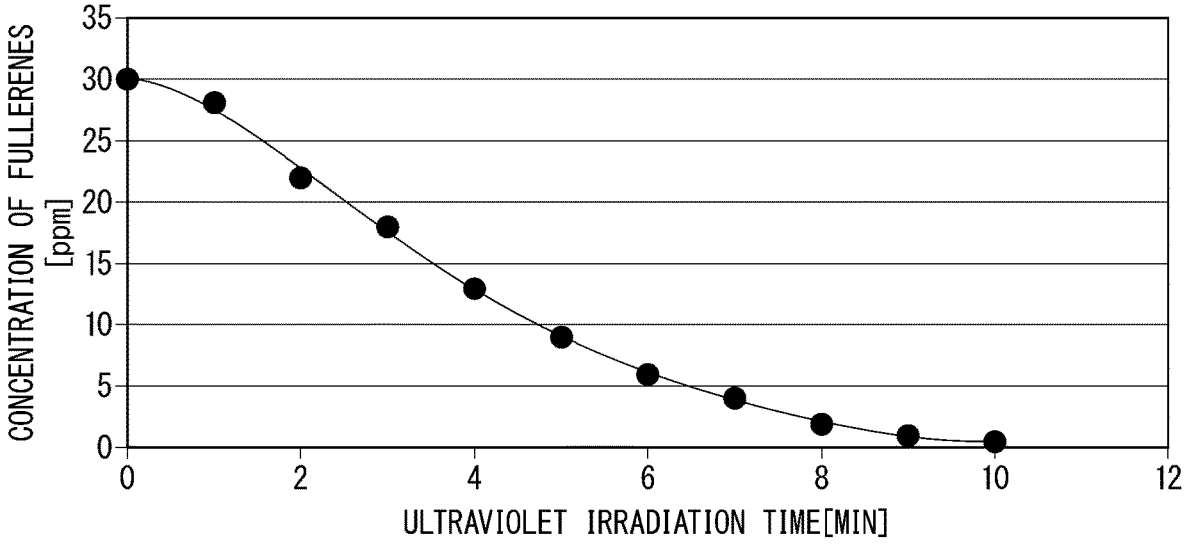
CONCENTRATION OF FULLERENES [ppm]
35
30
25
20
15
10
5
0
0
2
4
6
8
10
12
ULTRAVIOLET IRRADIATION TIME[MIN]

LUBRICATING OIL COMPOSITION AND METHOD FOR PRODUCING LUBRICATING OIL COMPOSITION

CROSS REFERENCE TO RELATED APPLICATIONS

This application is a National Stage of International Application No. PCT/JP2020/017424 filed Apr. 23, 2020, claiming priority based on Japanese Patent Application No. 2019-083393 filed Apr. 24, 2019, the contents of all of which are incorporated herein by reference in their entirety.

TECHNICAL FIELD

The present invention relates to a lubricating oil composition and a method for producing the lubricating oil composition.

BACKGROUND ART

In recent years, there has been strong demand for improvement in the performance of lubricating oils used in automobiles, home appliances, industrial machines, and the like along with the increase in speed, efficiency, and energy conservation therein. In order to improve properties to suit the applications thereof, various additives such as antioxidants, extreme pressure additives, rust preventive additives, and corrosion inhibitors are incorporated into lubricating oils. In addition, a lubricant having a high flash point is required.

In order to improve a plurality of types of performance such as having low friction, a high torque, and low fuel consumption simultaneously, Patent Literature 1 proposes an additive composition for an engine lubricating oil obtained by blending fullerenes as nanocarbon particles, an organic solvent, a viscosity index improver, a friction modifier, and a detergent dispersant with a lubricating base oil such as a mineral oil or an ester oil.

Patent Literature 2 proposes that friction or wear of a refrigerant compressor be suppressed by adding fullerenes having diameters of 100 pm to 10 nm to a refrigerating machine oil that lubricates a sliding portion of a refrigerant compressor.

CITATION LIST

Patent Literature

[Patent Literature 1]
Japanese Unexamined Patent Application, First Publication No. 2008-266501
[Patent Literature 2]
PCT International Publication No. WO 2017/141825

SUMMARY OF INVENTION

Technical Problem

However, in all of these proposals, thus obtained improvement in the performance, particularly improvement in the abrasion resistance is not sufficient, and there is room for improvement.

An object of the present invention is to provide a lubricating oil composition having improved abrasion resistance and a method for producing the same.

Solution to Problem

A first aspect of the present invention is the following method for producing a lubricating oil composition.

[1] A method for producing a lubricating oil composition, including: an irradiation step of irradiating a fullerene solution obtained by dissolving fullerenes in a base oil with radiation to produce fullerene adducts, in which the radiation is ultraviolet light or ionizing radiation.

The first aspect of the present invention preferably includes characteristics described [2] to [12] below.

[2] The method for producing a lubricating oil composition according to [1] above, further including: a removal step of removing an insoluble component from the fullerene solution.

[3] The method for producing a lubricating oil composition according to [1] or [2] above, in which, in the irradiation step, the radiation is emitted in a non-oxidizing atmosphere.

[4] The method for producing a lubricating oil composition according to [3] above, in which the radiation is emitted while setting an oxygen gas concentration in the fullerene solution to 10 mass ppm or less.

[5] The method for producing a lubricating oil composition according to any one of [1] to [4] above, in which the radiation is ultraviolet light.

[6] The method for producing a lubricating oil composition according to [5] above, in which the ultraviolet light has a wavelength of 190 nm to 365 nm.

[7] The method for producing a lubricating oil composition according to any one of [1] to [6] above, in which the radiation is emitted until a ratio of a concentration of the fullerenes in the fullerene solution after the irradiation step to a concentration of the fullerenes in the fullerene solution before the irradiation step is 0.1 times to 0.7 times.

[8] The method for producing a lubricating oil composition according to any one of [1] to [7], in which the fullerenes include $C_{60}$ or $C_{70}$ or a mixture thereof.

[9] The method for producing a lubricating oil composition according to any one of [1] to [8], in which, in the irradiation step, the radiation is emitted while controlling a temperature of the fullerene solution such that it is 40° C. to 200° C.

[10] The method for producing a lubricating oil composition according to any one of [1] to [9], in which, in the irradiation step, the radiation is emitted 2 to 9 times.

[11] The method for producing a lubricating oil composition according to any one of [1] to [10], in which, in the irradiation step, the fullerene solution is accommodated in a container and the radiation is emitted from outside of the container.

[12] The method for producing a lubricating oil composition according to any one of [1] to [11], in which, in the irradiation step, 1 g of the fullerene solution is irradiated with the radiation at an irradiation energy of 1 J to 100 J.

A second aspect of the present invention is the following lubricating oil composition.

[12] A lubricating oil composition including: a base oil; and fullerene adducts, in which added groups of the fullerene adducts have a part of a molecular structure constituting the base oil.

Advantageous Effects of Invention

According to the present invention, it is possible to provide a lubricating oil composition having improved abrasion resistance and a method for producing the same.

BRIEF DESCRIPTION OF DRAWINGS

FIG. 1 is a view showing a relationship between the concentration of fullerenes and ultraviolet irradiation time of a lubricating oil composition in Example 1.

DESCRIPTION OF EMBODIMENTS

Hereinafter, a lubricating oil composition and a method for producing the same according to a preferred embodiment of the present invention will be described. The present embodiment is specifically described to facilitate better understanding of the gist of the invention, and does not limit the present invention unless otherwise specified. For example, numerical values, orders, times, ratios, materials, amount, configurations, and the like can be, for example, modified, added, omitted, or replaced within the scope not departing from the gist of the present invention.

[Lubricating Oil Composition]

The lubricating oil composition of the present embodiment includes: a base oil; and fullerene adducts, in which an added group of the above-described fullerene adducts have a part of a molecular structure constituting the base oil. This lubricating oil composition can be obtained by irradiating a fullerene solution in which fullerenes are dissolved in the base oil with radiation such as ultraviolet light or ionizing radiation.

(Base Oil)

The base oil contained in the lubricating oil composition of the present embodiment is not particularly limited. However, in general, a mineral oil and a synthetic oil widely used as a base oil of a lubricating oil are suitably used.

A mineral oil used as a lubricating oil is generally one in which double bonds contained therein are saturated through hydrogenation and which has been converted into saturated hydrocarbons. Preferred examples of such mineral oils include a paraffinic base oil and a naphthenic base oil.

Examples of synthetic oils include a synthetic hydrocarbon oil, an ether oil, and an ester oil. Specifically, poly-α-olefin, diesters, polyalkylene glycols, poly-alpha-olefin, polyalkyl vinyl ether, polybutene, isoparaffin, olefin copolymers, alkylbenzene, alkylnaphthalene, diisodecyl adipate, monoesters, dibasic acid esters, tribasic acid esters, polyol esters (such as trimethylolpropane caprylate, trimethylolpropane pelargonate, pentaerythritol 2-ethylhexanoate, and pentaerythritol pelargonate), dialkyl diphenyl ethers, alkyl diphenyl sulfide, polyphenyl ethers, silicone lubricating oils (such as dimethyl silicones), perfluoropolyether, and the like are suitably used. Among these, poly-α-olefin, diesters, polyol esters, polyalkylene glycols, and polyalkyl vinyl ethers are more suitably used.

Such mineral oils or synthetic oils may be used singly, or two or more selected therefrom may be mixed at an arbitrary ratio and used.

The amount of base oil in a lubricating oil composition can be arbitrarily selected. For example, the amount thereof may be 90 mass % to 99.9999 mass %. However, the present invention is not limited to these examples.

(Fullerenes)

A fullerene used for producing the lubricating oil composition of the present embodiment is not particularly limited in its structure or production method, and various fullerenes can be used. Examples of fullerenes include $C_{60}$ and $C_{70}$ which are relatively easily available, and a mixture thereof. Among these fullerenes, $C_{60}$ and $C_{70}$ are preferable from the viewpoint of high solubility in lubricating oils, and $C_{60}$ is more preferable from the viewpoint that there is little coloring in a lubricating oil (from the viewpoint that deterioration of a lubricating oil composition is easily determined by color). In a case of a mixture thereof, fullerenes of higher order than $C_{70}$ may be included, but the content of $C_{60}$ with respect to the total content of fullerenes constituting the mixture is preferably greater than or equal to 50 mass %. The content thereof may be 70 mass % to 100 mass %, or may be 90 mass % to 100 mass %.

In a case where a fullerene solution containing a base oil and a fullerene is irradiated with radiation in the process of producing the lubricating oil composition of the present embodiment, fullerene adducts (FLN adducts) are produced. Therefore, the concentration of the fullerenes after the irradiation is lower than that of the fullerenes before the irradiation. In a case where the concentration of the fullerenes after the irradiation is not 0, the lubricating oil composition of the present embodiment contains a base oil, a fullerene, and fullerene adducts.

(Fullerene Adducts)

The lubricating oil composition of the present embodiment contains fullerene adducts. The fullerene adducts have a structure in which an added group having a part of a molecular structure constituting the above-described base oil is added to the above-described fullerene. In a case where the concentration of the fullerenes after the irradiation is 0, the lubricating oil composition of the present embodiment contains a base oil and fullerene adducts.

(Additives)

The lubricating oil composition of the present embodiment can contain additives in addition to the base oil and the fullerene adducts within a range not impairing the effects of the present embodiment.

Additives to be added to the lubricating oil composition of the present embodiment are not particularly limited. Examples of additives include antioxidants, viscosity index improvers, extreme pressure additives, detergent dispersants, pour point depressants, corrosion inhibitors, solid lubricants, oiliness improvers, rust preventive additives, anti-emulsifiers, antifoaming agents, and hydrolysis inhibitors which are commercially available. Such additives may be used alone or in a combination of two or more thereof. The amount of additive can be arbitrarily selected.

Regarding an additive, one having an aromatic ring is more preferable because it sometimes improves the solubility of fullerenes.

Examples of antioxidants having an aromatic ring include dibutylhydroxytoluene (BHT), butylhydroxyanisole (BHA), 2,6-di-tert-butyl-p-cresol (DBPC), 3-arylbenzofuran-2-one (an intramolecular cyclic ester of hydroxycarboxylic acid), phenyl-α-naphthylamine, dialkyldiphenylamine, and benzotriazole.

Examples of viscosity index improvers having an aromatic ring include polyalkylstyrenes or hydrogenated styrene-diene copolymers.

Examples of extreme pressure additives having an aromatic ring include dibenzyl disulfide, an allyl phosphate ester, an allyl phosphite ester, an amine salt of an allyl phosphate ester, an allyl thiophosphate ester, an amine salt of an allyl thiophosphate ester, and a naphthenic acid.

Examples of detergent dispersants having an aromatic ring include benzylamine, succinic acid derivatives, and alkylphenol amines.

Examples of pour point depressants having an aromatic ring include chlorinated paraffin-naphthalene condensates, chlorinated paraffin phenol condensates, and polyalkylstyrene-based pour point depressants.

Examples of anti-emulsifiers having an aromatic ring include alkylbenzene sulfonates.

Examples of corrosion inhibitors having an aromatic ring include dialkylnaphthalene sulfonates.

The lubricating oil composition of the present embodiment is a lubricating oil composition produced through a method for producing a lubricating oil composition to be described below.

The lubricating oil composition of the present embodiment contains a base oil and fullerene adducts. Since an added group of the fullerene adducts has a part of a molecular structure constituting the base oil, precipitation of fullerene aggregates can reduced by improvement in affinity between the fullerene adducts and the base oil and the abrasion resistance can be improved. In addition, an effect of reducing frictional resistance can be expected.

(Method for Producing Lubricating Oil Composition)

A method for producing a lubricating oil composition of the present embodiment includes an irradiation step of irradiating a fullerene solution in which fullerenes are dissolved in a base oil with radiation, in which the above-described radiation is ultraviolet light or ionizing radiation.

The above-described fullerene solution is obtained, for example, by mixing a base oil with fullerenes and dissolving the fullerenes in the base oil. That is, the method for producing a lubricating oil composition may include a dissolution step of dissolving fullerenes in a base oil to obtain a fullerene solution before the above-described irradiation step.

In addition, the fullerene solution obtained in the above-described dissolution step sometimes contains insoluble fullerenes or the like. In this case, the insoluble component is preferably removed. That is, the method for producing a lubricating oil composition according to the present embodiment may further include a removal step of removing an insoluble component from the above-described fullerene solution. The above-described removal step is preferably provided after the above-described dissolution step and between the above-described dissolution step and the above-described irradiation step.

Furthermore, the method for producing a lubricating oil composition of the present embodiment may further include a dilution step of diluting the fullerene solution obtained in the above-described dissolution step or the above-described removal step or the fullerene solution obtained in the above-described irradiation step with a base oil to obtain a fullerene solution having a desired concentration of fullerenes (or a desired concentration of fullerene adducts) after the above-described dissolution step and the above-described removal step or the above-described irradiation step. The fullerene solution obtained in this way is used as a lubricating oil composition of the present embodiment.

(Dissolution Step)

Fullerenes are mixed with a base oil to dissolve the fullerenes in the base oil. At this time, it is preferable to perform a dispersion treatment with a stirrer or the like or to further perform a heat treatment for 3 hours to 48 hours during the above-described dispersion treatment as necessary in view of promoting dissolution of fullerenes. Examples of dispersion treatments for dispersing fullerenes in a base oil include a dispersion treatment using dispersion means such as a stirrer, an ultrasonic disperser, a homogenizer, a ball mill, or a beads mill.

The amount of fullerenes incorporated is set in consideration of, for example, the concentration of fullerenes (fullerene adducts) of a lubricating oil composition to be finally prepared. Specifically, it is preferable that the amount of fullerenes incorporated be set so as to be preferably 1.2 times to 5 times and more preferably 1.2 times to 3 times the amount of fullerenes in which the desired concentration of fullerenes with respect to a base oil on calculation can be obtained. Within these ranges, the amount of soluble component that can be extracted is sufficient, the desired concentration of the fullerenes can be easily obtained, and the load does not increase in the above-described removal step of removing an insoluble component. In addition, the amount of fullerenes incorporated may be set in consideration of a fullerene residual ratio described in detail below.

The concentration of the fullerenes dissolved in the fullerene solution is preferably 1 mass ppm (0.0001 mass %) to 10,000 mass ppm (1.0 mass %), more preferably 1 mass ppm (0.0001 mass %) to 100 mass ppm (0.01 mass %), and still more preferably 5 mass ppm (0.0005 mass %) to 50 mass ppm (0.005 mass %). If the concentration of the fullerenes is within the above-described ranges, the effect of improving abrasion resistance in the finally obtained lubricating oil composition can be maintained for a long period of time. The concentration of the fullerenes may be measured through an arbitrarily selected method, for example, a technique using high-performance liquid chromatography (HPLC).

(Removal Step)

In a case where the mixture obtained in the dissolution step contains an aggregate of fullerenes, an undissolved fullerene, or the like as an insoluble component, it is easier to improve the abrasion resistance by removing the insoluble component. Therefore, it is preferable that a fullerene solution from which an insoluble component is removed be obtained by providing a removal step of removing the insoluble component after the above-described dissolution step. The fullerene solution that has undergone the above-described removal step is sometimes simply referred to as a "fullerene solution" unless otherwise specified.

Examples of methods for removing an insoluble component in the removal step include a method for performing filtering with a membrane filter, a method for performing precipitation and separation using a centrifuge, and a method of using these methods in combination. Among these, from the viewpoint of filtration time, a method for performing filtering with a membrane filter is preferable in a case of obtaining a small amount of lubricating oil composition and a method of using a centrifuge is preferable in a case of obtaining a large amount of lubricating oil composition.

In the removal step in which a membrane filter is used, the mixture of the fullerenes and the base oil obtained in the above-described dissolution step is filtered with a small-mesh filter (for example, a membrane filter with a mesh opening of 0.1 μm to 1 μm) and collected as a fullerene solution, for example. In order to shorten the filtration time, suction filtration is preferably performed, for example.

In the method in which a centrifuge is used, for example, the fullerene solution obtained in the above-described dissolution step is subjected to a centrifugation treatment, and a supernatant is collected to obtain a fullerene solution after the above-described removal step.

(Irradiation Step)

The fullerene solution obtained in the above-described dissolution step or the above-described removal step is irradiated with radiation to produce fullerene adducts in the fullerene solution. The dilution step of diluting the fullerene solution with a base oil may be performed after the above-described dissolution step or the above-described removal step and before the above-described irradiation step, and then the diluted fullerene solution may be subjected to irradiation.

The fullerene solution is usually handled in atmospheric air. For this reason, the concentration of oxygen gas in the solution is in equilibrium with oxygen gas in atmospheric air. In addition, in order to efficiently produce fullerene adducts, a non-oxidizing atmosphere is preferable. For this reason, the above-described irradiation is preferably performed in a non-oxidizing atmosphere. Specifically, the above-described irradiation is preferably performed while setting the concentration of oxygen gas in the fullerene solution to less than or equal to 10 mass ppm. In addition, the concentration of oxygen gas in the above-described fullerene solution is more preferably less than or equal to 5 mass ppm and still more preferably less than or equal to 1 mass ppm. The concentration of oxygen gas in the fullerene solution can be measured using a dissolved oxygen meter.

In the above-described irradiation step, it is preferable that the concentration of oxygen gas in the fullerene solution be reduced as described above before the irradiation, and then irradiation be performed while maintaining this state. Specific examples of the irradiation step include the following three methods. The present embodiment is not limited to the following specific examples.

First Irradiation Step

After accommodating the fullerene solution obtained in the above-described dissolution step or the above-described removal step in an airtight container made of a metal such as stainless steel, the container is sealed. Subsequently, the inside of the container is purged with an inert gas such as nitrogen gas or argon gas, and an inert gas may also be bubbled into the fullerene solution in the container to create an equilibrium between the fullerene solution and the inert gas. A radiation source is placed in the container while maintaining this state, the container is sealed again, and the fullerene solution is irradiated with radiation. In a case where ultraviolet light is used as radiation, examples of radiation sources include a UV lamp.

In this method, the concentration of oxygen gas in the fullerene solution can be controlled such that it is a desired value or less by controlling the concentration of oxygen gas as an impurity contained in an inert gas such that it is 1 volume % or less.

Second Irradiation Step

Irradiation is performed by decompressing the inside of an airtight container instead of substituting the inside of the container with an inert gas and further bubbling the fullerene solution in the first irradiation step. That is, the second irradiation step is different from the first irradiation step in that the irradiation step is performed by decompressing the inside of an airtight container without bubbling the fullerene solution. In the second irradiation step, the pressure at the time of decompression is preferably 10 Pa or less. Other conditions may be the same as those in the first irradiation step.

Third Irradiation Step

Radiation is emitted from outside of a container instead of placing a radiation source in the container in the first irradiation step or the second irradiation step. That is, the third irradiation step is different from the first irradiation step and the second irradiation step in that radiation is emitted from outside of a container. In this case, a container of which the entirety or a part is made of a material through which radiation is transmitted is used. In a case where ultraviolet light is used as radiation, examples of materials include quartz glass. The irradiation step is performed by lowering the concentration of oxygen gas inside the container while keeping other conditions the same as those in the first irradiation step or the second irradiation step. Next, the fullerene solution is irradiated with radiation from outside through a radiation transmission portion of the above-described container. According to this method, since a radiation source can be placed outside the container, there are few restrictions on the size or the like of the radiation source.

The concentration of the fullerenes in the fullerene solution decreases with the irradiation. The reason why the concentration of the fullerenes in the fullerene solution decreases in this manner is that some of the base oil absorbs energy of emitted radiation, a radical in which molecular chains of the base oil are cleaved (hereinafter, referred to as "cleaved molecules") is produced, and the radical is added to a fullerene to produce fullerene adducts. When an adduct is produced on the fullerene in this manner, the fullerene is consumed.

Although the concentration of the fullerene adducts in the fullerene solution is preferably measured and controlled directly, the measurement thereof is not as simple as measuring the concentration of fullerenes. This is because fullerene adducts are a mixture of different added groups of the fullerene adducts since the size of cleaved molecules is not constant depending on where molecules of a base oil are cleaved. For this reason, it is convenient to use the concentration of the fullerenes remaining after the irradiation as an index for the amount of fullerene adducts produced. A preferred example of a method for obtaining the amount of fullerene adducts produced using the concentration of the fullerenes as an index is shown below.

Specifically, it is preferable that the concentration of the fullerenes in the fullerene solution before and after the irradiation be measured, the fullerene residual ratio be calculated by the following equation, and the obtained value be within a certain range.

[Fullerene residual ratio]=[concentration (mass ppm) of fullerenes after irradiation]/[concentration (mass ppm) of fullerenes before irradiation]

The fullerene residual ratio during the irradiation may be similarly obtained while replacing the "concentration of fullerenes after irradiation" with the "concentration of fullerenes during irradiation".

In addition, the concentration of the fullerenes in the fullerene solution can be measured through a technique using high-performance liquid chromatography (HPLC) as shown in examples to be described below.

At this time, it is preferable that the above-described radiation be emitted until a ratio of the concentration of the fullerenes in the above-described fullerene solution after the above-described irradiation step to the concentration of the fullerenes in the above-described fullerene solution before the above-described irradiation step is 0.1 times to 0.7 times. That is, the above-described fullerene residual ratio is preferably 0.1 to 0.7 and more preferably 0.2 to 0.5. The higher the fullerene residual ratio, the more cleaved molecules of a base oil produced during use of a lubricating oil composition tend to be captured. For this reason, the lubricating oil composition is suitable for use in an environment where the above-described cleaved molecules are likely to be produced.

On the other hand, the lower the fullerene residual ratio, the lower the concentration of fullerenes in the fullerene solution, such that the precipitation of fullerene aggregates and the like tends to be suppressed in various environments during use as a lubricating oil composition. For this reason, a more stable lubricating oil composition can be obtained. Since fullerenes react to some extent to form fullerene adducts, the amount of the above-described cleaved molecules which are newly produced during use of the lubricating oil composition and can be captured is reduced by that amount. However, one fullerene molecule can capture several cleaved molecules, it is possible to capture cleaved molecules even if the fullerene residual ratio is 0. Accordingly, in the present invention, the "fullerene solution" includes a solution which contains fullerene adducts and has a fullerene residual ratio of 0. That is, the lubricating oil composition may contain no fullerene.

As a method for controlling a fullerene residual ratio, the concentration of fullerenes during irradiation may be sequentially measured and the irradiation may be terminated when a desired fullerene residual ratio is obtained. Alternatively, if irradiation is performed under a certain condition, a calibration curve between the fullerene residual ratio and the irradiation time may be previously created under the same conditions, and the irradiation time may be determined according to a desired fullerene residual ratio. In addition, a calibration curve between the concentration of the fullerenes in the fullerene solution and the irradiation time may be created, and the irradiation time may be determined according to a desired concentration of the fullerenes.

The change of the fullerene to the fullerene adducts can be confirmed by performing mass spectrum measurement on the fullerene solution before and after the irradiation. For example, in a case of a fullerene solution in which $C_{60}$ is dissolved as a fullerene, only the peak of m/z=720 corresponding to $C_{60}$ is confirmed before the irradiation. On the other hand, after the irradiation, the peak of 720 is reduced, and a plurality of peaks of fullerene adducts appear. As the main peak, a peak (722÷2N) corresponding to a compound in which a plurality of alkyl groups having different chain lengths are added to $C_{60}$ can be confirmed. N is a natural number of 60 or less. These are thought that two alkyl radical molecules produced through cleavage of a base oil are added to $C_{60}$.

In general, from only energy based on the wavelength of radiation, a C—C single bond is cleaved by ultraviolet light with a wavelength of 341 nm or less, for example. However, in reality, since thermal vibrations of carbon atoms are superimposed, the single bond is cleaved even by ultraviolet light with a wavelength longer than 341 nm. In addition, low-energy radiation is preferable as long as sufficient cleaved molecules can be produced. It is thought that, with low energy, binding sites in base oil molecules to be cleaved are limited, relatively large cleaved molecules retaining partial shapes of molecules of the original base oil are likely to be obtained, and affinity between the base oil and the obtained fullerene adducts improves.

From such a viewpoint, the radiation used in the above-described ultraviolet treatment step is radiation having energy to generate cleaved molecules, specifically, ultraviolet light or ionizing radiation, and preferably ultraviolet light. From the viewpoint of stability of an obtained lubricating oil composition, low-energy radiation is preferable as long as sufficient cleaved molecules can be produced. In addition, from the viewpoint of facilitating industrial handling, the above-described ultraviolet light more preferably has a wavelength of 190 nm to 365 nm and still more preferably has a wavelength of 240 nm to 340 nm.

It is thought that, since the fullerene adducts produced in this manner include a part of a molecular structure of the base oil, it has high affinity with the base oil and excellent solubility compared to a fullerene. For this reason, precipitation of fullerene aggregates or the like in an obtained lubricating oil composition is unlikely to occur. That is, the stability of a lubricating oil composition improves.

Examples of the above-described ultraviolet sources include general low-pressure mercury lamps, UV ozone lamps, ultraviolet LEDs, excimer lamps, and xenon lamps.

The irradiation dose of radiation can be defined as an irradiation energy amount. That is, the energy density (mW/$cm^2$) of radiation is previously measured using a dosimeter of radiation to be used, and then the irradiation time (seconds) and the irradiation range ($cm^2$) are determined. Accordingly, the energy (J) of radiation to be emitted can be determined. The irradiation time can be arbitrarily selected. For example, the irradiation time may be 5 minutes to 24 hours. Alternatively, the irradiation time may be 0.1 seconds to 1 hour, 0.2 seconds to 30 minutes, 0.3 seconds to 3 minutes, 0.5 seconds to 60 seconds, or 1 second to 30 seconds.

Specific standards of the irradiation energy amount per gram of the fullerene solution are preferably 1 J to 100 J, more preferably 1.5 J to 60 J, and still more preferably 2 J to 20 J. The irradiation energy amount may be, for example, 1 J to 10 J and 1 J to 8 J. Within the ranges, the fullerene residual ratio obtained from the above-described equation, that is, the range of the fullerene residual ratio is easily adjusted to 0.1 to 0.7. The irradiation may be performed only once, or the irradiation may be plural times while being divided into two or more times, for example. The irradiation may be performed under the same conditions. In a case where the irradiation is divided into plural times, the total energy amount of radiation is preferably within the above-described range. The number of times of irradiation can be arbitrarily selected and may be, for example, within a range of 1 to 10 times or a range of 2 to 5 times. However, the present invention is not limited to these examples. In addition, the irradiation is preferably repeated one or more times until a target fullerene residual ratio is obtained.

The temperature of the fullerene solution during irradiation may not be particularly controlled and may be kept near room temperature. However, by actively superimposing the above-described thermal vibrations, it is possible to shorten the irradiation time and effectively use a longer wavelength side especially from an ultraviolet source having a wavelength distribution. Specifically, the temperature of the fullerene solution during irradiation is preferably 40° C. to 200° C., more preferably 60° C. to 150° C., and still more preferably 80° C. to 120° C.

(Dilution Step)

Furthermore, a dilution step of diluting a fullerene solution obtained after the above-described dissolution step, preferably after the above-described removal step or the above-described irradiation step, still more preferably after the above-described irradiation step with a base oil may be further provided to obtain a lubricating oil composition having a desired concentration of fullerenes or fullerene adducts.

The base oil used for dilution in the above-described dilution step may be the same type of base oil as that used in the above-described dissolution step, or may be a base oil different from that used in the above-described dissolution step.

The standard of the concentration of fullerene adducts in a fullerene solution can be calculated by the following equation using the above-described fullerene residual ratio and the concentration of fullerenes measured through HPLC as described above.

[Concentration (mass ppm) of fullerene adducts]=(1−[fullerene residual ratio])×[concentration (mass ppm) of fullerenes]

However, the numerical value obtained by the above-described equation is a concentration in terms of a fullerene, and the concentration of oxygen molecules in a fullerene solution is sufficiently negligibly low.

According to the method for producing a lubricating oil composition of the present embodiment, a lubricating oil composition capable of improving abrasion resistance can be obtained by producing fullerene adducts by irradiating a fullerene solution in which fullerene are dissolved in a base oil with ultraviolet light or ionizing radiation.

Although the preferred embodiment of the present invention has been described in detail above, the present invention is not limited to a specific embodiment and various modifications and changes can be made within the scope of the gist of the present invention disclosed in the claims.

EXAMPLES

Hereinafter, the present invention will be described in more detail using examples and comparative examples, but is not limited to the following examples.

(Measurement of Concentration of Fullerenes)

The concentration of fullerenes was measured using high-performance liquid chromatography (manufactured by Agilent Technologies, 1200 series). Specifically, the concentration thereof was detected at an absorbance (wavelength of 309 nm) using a column YMC-Pack ODS-AM (150 mm×4.6) manufactured by YMC CO., LTD, and a 1:1 (volume ratio) mixture of toluene and methanol as a development solvent to quantitatively determine the amount of fullerene in a sample such as a fullerene solution or a lubricating oil composition.

Example 1

(Preparation of Lubricating Oil Composition)

100 g of a mineral oil (manufactured by Idemitsu Kosan Co., Ltd., Diana Fresia P46) as a base oil was mixed with 0.003 g (30 mg) of a fullerene raw material (manufactured by Frontier Carbon Corporation, Nanom™ NP-ST, $C_{60}$≥99 mass %). The obtained mixture was stirred with a stirrer at room temperature for 36 hours. Next, this mixture was passed through a membrane filter having a mesh size of 0.1 μm to obtain a filtrate. The concentration of the fullerenes in the obtained filtrate was measured, and the result was 300 mass ppm.

Next, this filtrate was diluted with the same mineral oil as the above-described base oil so as to have a fullerene concentration of 30 mass ppm to obtain a fullerene solution (lubricating oil composition).

Next, 200 g of the fullerene solution was transferred to a 300 mL four-neck eggplant flask made of quartz glass, a Liebig condenser tube was attached to a first neck, a silicone septum cap was attached to a second neck, a nitrogen gas introduction tube was attached to a third neck, and a detection unit of a dissolved oxygen meter (manufactured by Iijima Denshi Kogyo Co., Ltd., B-506) was attached to a fourth neck.

Here, the concentration of oxygen gas dissolved in the fullerene solution was measured according to the following procedure.

First, 100 mL of n-dodecane (manufactured by Wako Pure Chemical Industries, Ltd.) was previously taken out into a 250 mL beaker and bubbled with air for 10 minutes. Thereafter, a dissolved oxygen meter was used, and the concentration of oxygen gas of the n-dodecane solution was set as a standard (saturation degree of 100%).

Next, the concentration of saturated oxygen in the fullerene solution in the above-described four-neck eggplant flask was measured with a dissolved oxygen meter. As a result, the concentration of saturated oxygen in the fullerene solution was 70%.

Then, the concentration of saturated oxygen in n-dodecane in air was set to 73 mass ppm, and the concentration of dissolved oxygen in the fullerene solution calculated was 51 mass ppm from the product of the previous 70% and the set numerical value.

Next, nitrogen gas was injected into the four-neck eggplant flask through the nitrogen gas introduction tube at a flow rate of 1 L/min and was allowed to stand in this state for 10 minutes. Accordingly, the inside of the four-neck eggplant flask was made into a nitrogen gas atmosphere.

Next, the concentration of oxygen gas in the fullerene solution was measured with a dissolved oxygen meter. As a result, the concentration of dissolved oxygen in the fullerene solution was 3% (2.2 mass ppm).

Next, the fullerene solution placed in the four-neck eggplant flask was irradiated with ultraviolet light from outside of the four-neck eggplant flask. The ultraviolet irradiation was set so that 60 J/cm$^2$ of energy (0.6 J per gram of the fullerene solution) could be emitted with one irradiation using an ultraviolet irradiation device (manufactured by San-Ei Tech Ltd., OmniCure S2000). The mesh size of a filter was set to 250 nm to 450 nm, the output was adjusted to 1 W/cm$^2$ while measurement was performed using an ultraviolet illuminometer (wavelength of 230 nm to 390 nm) within an irradiation range of 2 cm$^2$, and the irradiation timer was set to 1 minute.

Next, about 0.01 mL of the fullerene solution was sampled from the inside of the four-neck eggplant flask every ultraviolet irradiation using an injector, and the concentration of the fullerenes was measured to obtain the fullerene residual ratio.

Since the concentration of the fullerenes in the fullerene solution was 18 mass ppm (fullerene residual ratio of 0.6) after three times of the ultraviolet irradiation (1.8 J per gram of the fullerene solution), 10 g of the fullerene solution was taken out of the four-neck eggplant flask to obtain a lubricating oil composition.

Furthermore, the ultraviolet irradiation was performed 10 times in total (10 minutes in total) while adjusting the irradiation range so that the amount of energy became 0.6 J per gram of the fullerene solution with one irradiation, and the concentration of the fullerenes was measured in the same manner as described above each time ultraviolet light is emitted. A calibration curve was obtained by creating a graph in which the integrated time (minutes) of the ultraviolet irradiation was plotted on the lateral axis and the concentration (mass ppm) of the fullerenes was plotted on the longitudinal axis. The results are shown in FIG. 1. The calibration curve is represented by the following equation.

$$y=0.0015x^5-0.0459x^4+0.5164x^3-2.3125x^2-0.7653x+30.111$$

x: Ultraviolet irradiation time (minutes)

y: Concentration (mass ppm) of fullerenes

By using the calibration curve as shown in FIG. 1, it is possible to previously predict the required ultraviolet irradiation time with respect to a target concentration of fullerenes. Therefore, it is possible to omit operations of quantitatively determining the concentration of the fullerenes every time the fullerene solution was sampled and it is possible to easily obtain a fullerene solution having a desired concentration of the fullerenes.

(Evaluation of Abrasion Resistance)

The abrasion resistance of the obtained lubricating oil composition was evaluated using an abrasion resistance tester (manufactured by Anton Paar, Ball-On-Disc Tribometer).

First, a substrate and a ball were prepared, and the materials thereof were set to a high carbon chromium bearing steel material SUJ2. The diameter of the ball was set to 6 mm.

The lubricating oil composition was applied to one main surface of the substrate, and the substrate was rotated and the fixed ball was slid on the one main surface of the substrate via the lubricating oil composition so that the ball drew a concentric orbit on the substrate. The speed of the ball on the one main surface of the substrate was set to 50 cm/sec, and the load of the ball on the one main surface of the substrate was set to 25 N. The worn area (circle) of the ball surface when the sliding distance of the ball on the one main surface of the substrate was 1,500 m in total was observed with an optical microscope, and the diameter of the worn area formed on the ball was measured. It can be said that the smaller the diameter of the worn area, the better the abrasion resistance. The results are summarized in Table 1. In Example 1, the concentration of the fullerenes (FLN concentration) in the fullerene solution after the ultraviolet irradiation was 18 mass ppm, the fullerene residual ratio (FLN residual rate) was 0.60, and the diameter of the worn area was 170 μm.

Example 2

A lubricating oil composition was obtained in the same manner as in Example 1 except that nitrogen gas containing 5 volume % oxygen gas was used and the ultraviolet irradiation was performed only three times.

The concentration of dissolved oxygen in the fullerene solution before the ultraviolet irradiation was 8.8 mass ppm, and the concentration of the fullerenes in the fullerene solution after the ultraviolet irradiation was 17 mass ppm (fullerene residual ratio of 0.57). The abrasion resistance of the obtained lubricating oil composition was evaluated in the same manner as in Example 1. The diameter of the worn area was 175 μm. The results are shown in Table 1.

Example 3

A lubricating oil composition was obtained in the same manner as in Example 2 except that air was used instead of nitrogen gas containing 5 volume % oxygen gas.

The concentration of dissolved oxygen in the fullerene solution before the ultraviolet irradiation was 51 mass ppm, and the concentration of the fullerenes in the fullerene solution after the ultraviolet irradiation was 15 mass ppm (fullerene residual ratio of 0.50). The abrasion resistance of the obtained lubricating oil composition was evaluated in the same manner as in Example 1. The diameter of the worn area was 210 μm. The results are summarized in Table 1.

Comparative Example 1

A lubricating oil composition was obtained in the same manner as in Example 1 except that no fullerene was incorporated and no ultraviolet irradiation was performed. The abrasion resistance of the obtained lubricating oil composition (that is, the base oil alone) was evaluated in the same manner as in Example 1. The results are summarized in Table 1.

Comparative Example 2

A lubricating oil composition was obtained in the same manner as in Example 1 except that the fullerene was not incorporated. The abrasion resistance of the obtained lubricating oil composition (that is, the base oil irradiated with ultraviolet light) was evaluated in the same manner as in Example 1. The results are summarized in Table 1.

Comparative Example 3

A lubricating oil composition was obtained in the same manner as in Example 1 except that no ultraviolet irradiation was performed. The concentration of the fullerenes in the lubricating oil composition was 30 ppm. The abrasion resistance of the obtained lubricating oil composition was evaluated in the same manner as in Example 1. The results are summarized in Table 1.

TABLE 1

| | Composition of lubricating oil composition | | Treatment of producing FLN adduct | | | After irradiation treatment | | |
|---|---|---|---|---|---|---|---|---|
| | FLN concentration [mass ppm] | Base oil | Concentration [mass ppm] of dissolved oxygen | Irradiation Conditions | Heating condition | FLN concentration [mass ppm] | FLN residual rate [—] | Diameter [um] of worn area |
| Example 1 | 30 | P46 | 2.2 | Ultraviolet light, 60 J/cm$^2$ × three times | No heating | 18 | 0.60 | 170 |
| Example 2 | 30 | P46 | 8.8 | Ultraviolet light, 60 J/cm$^2$ × three times | No heating | 17 | 0.57 | 175 |

TABLE 1-continued

| | Composition of lubricating oil composition | | Treatment of producing FLN adduct Concentration | | | After irradiation treatment | | |
|---|---|---|---|---|---|---|---|---|
| | FLN concentration [mass ppm] | Base oil | [mass ppm] of dissolved oxygen | Irradiation Conditions | Heating condition | FLN concentration [mass ppm] | FLN residual rate [—] | Diameter [um] of worn area |
| Example 3 | 30 | P46 | 51 (air) | Ultraviolet light, 60 J/cm$^2$ × three times | No heating | 15 | 0.50 | 210 |
| Comparative Example 1 | 0 | P46 | 2.2 | No ultraviolet radiation | No heating | 0 | 0 | 270 |
| Comparative Example 2 | 0 | P46 | 2.2 | Ultraviolet light, 60 J/cm$^2$ × three times | No heating | 0 | 0 | 280 |
| Comparative Example 3 | 30 | P46 | 2.2 | No ultraviolet irradiation | No heating | 30 | 1 | 233 |

From the results of Table 1, it was found that the base oil alone had low abrasion resistance as in Comparative Example 1. It was found from the comparison between Comparative Example 1 and Comparative Example 2 that the base oil with ultraviolet irradiation (Comparative Example 2) had lower abrasion resistance than that of the base oil alone (Comparative Example 1).

In addition, the abrasion resistance in Comparative Example 3 where fullerenes were added but no ultraviolet irradiation was performed was further improved compared to that of the case with the base oil alone (Comparative Example 1).

On the other hand, comparing Comparative Example 3 with Examples 1 to 3, it was found that the abrasion resistance in Examples 1 to 3 with ultraviolet irradiation was further improved compared to that of Comparative Example 1.

That is, it can be seen that the abrasion resistance improves due to ultraviolet irradiation in a case where fullerenes are added to a base oil as in the comparison of Comparative Example 1 with Examples 1 to 3, whereas the abrasion resistance deteriorates due to ultraviolet irradiation in a case where no fullerene is added to a base oil as in the comparison between Comparative Example 1 and Comparative Example 2.

In addition, it was found in Examples 1 to 3 that the lower the concentration of oxygen gas in the fullerene solution, the better the abrasion resistance.

Example 4

A lubricating oil composition was obtained in the same manner as in Example 1 except that a bottom portion of the four-neck eggplant flask was immersed in an oil bath, the fullerene solution was heated at 50° C., and the ultraviolet irradiation was performed three times. The concentration of the fullerenes in the fullerene solution after the ultraviolet irradiation was 15 mass ppm (fullerene residual ratio of 0.50). The abrasion resistance of the obtained lubricating oil composition was evaluated in the same manner as in Example 1. The diameter of the worn area was 160 μm. The results are summarized in Table 2.

Example 5

A lubricating oil composition was obtained in the same manner as in Example 4 except that the fullerene solution was heated at 100° C. The concentration of the fullerenes in the fullerene solution after the ultraviolet irradiation was 10 mass ppm (fullerene residual ratio of 0.33). The abrasion resistance of the obtained lubricating oil composition was evaluated in the same manner as in Example 1. The diameter of the worn area was 150 μm. The results are summarized in Table 2.

Example 6

A lubricating oil composition was obtained in the same manner as in Example 4 except that the fullerene solution was heated at 160° C. The concentration of the fullerenes in the fullerene solution after the ultraviolet irradiation was 5 mass ppm (fullerene residual ratio of 0.17). The abrasion resistance of the obtained lubricating oil composition was evaluated in the same manner as in Example 1. The diameter of the worn area was 165 μm. The results are summarized in Table 2.

TABLE 2

| | Composition of lubricating oil composition | | Treatment of producing FLN adduct Concentration | | | After irradiation treatment | | |
|---|---|---|---|---|---|---|---|---|
| | FLN concentration [mass ppm] | Base oil | [mass ppm] of dissolved oxygen | Irradiation conditions | Heating condition | FLN concentration [mass ppm] | FLN residual rate [—] | Diameter [um] of worn area |
| Example 4 | 30· | P46 | 2.2 | Ultraviolet light, 60 J/cm$^2$ × three times | 50° C. | 15 | 0.50 | 160 |

TABLE 2-continued

| | Composition of lubricating oil composition | | Treatment of producing FLN adduct | | | After irradiation treatment | | |
|---|---|---|---|---|---|---|---|---|
| | FLN concentration [mass ppm] | Base oil | Concentration [mass ppm] of dissolved oxygen | Irradiation conditions | Heating condition | FLN concentration [mass ppm] | FLN residual rate [—] | Diameter [um] of worn area |
| Example 5 | 30 | P46 | 2.2 | Ultraviolet light, 60 J/cm$^2$ × three times | 100° C. | 10 | 0.33 | 150 |
| Example 6 | 30 | P46 | 2.2 | Ultraviolet light, 60 J/cm$^2$ × three times | 160° C. | 5 | 0.17 | 165 |

Comparing Example 1 with Examples 4 to 6, it was found that, in a case where the ultraviolet irradiation time was constant, heating the fullerene solution improved the abrasion resistance. In other words, in a case where the same abrasion resistance is obtained, the ultraviolet irradiation time can be shortened due to the heating.

In addition, in Examples 4 to 6, the heating conditions such as the heating time except for the heating temperature were the same as each other. Comparing Example 5 with Examples 4 and 6, it was found that Example 5 had the best abrasion resistance and had an optimum temperature range. It is thought that the reason is as follows. Although the abrasion resistance improves due to a high heating temperature, in a case where the heating temperature is increased above a certain level, even if the above-described thermal vibrations are further superimposed, the ultraviolet light on the long wavelength side of the emitted ultraviolet light is fully used. In addition, if the temperature is further increased, the temperature approaches (or exceeds) the upper limit temperature at which the base oil is used. As a result, it causes deterioration of the base oil and reduces the lubricity of the lubricating oil composition.

Example 7

A lubricating oil composition was obtained in the same manner as in Example 1 except that the number of times of the ultraviolet irradiation was set to 2. The concentration of the fullerenes in the fullerene solution after the ultraviolet irradiation was 22 mass ppm (fullerene residual ratio of 0.73). The abrasion resistance of the obtained lubricating oil composition was evaluated in the same manner as in Example 1. The diameter of the worn area was 200 μm. The results are summarized in Table 3.

Example 8

A lubricating oil composition was obtained in the same manner as in Example 1 except that the number of times of the ultraviolet irradiation was set to 7. The concentration of the fullerenes in the fullerene solution after the ultraviolet irradiation was 4 mass ppm (fullerene residual ratio of 0.13). The abrasion resistance of the obtained lubricating oil composition was evaluated in the same manner as in Example 1. The diameter of the worn area was 160 μm. The results are summarized in Table 3.

Example 9

A lubricating oil composition was obtained in the same manner as in Example 1 except that the number of times of the ultraviolet irradiation was set to 9. The concentration of the fullerenes in the fullerene solution after the irradiation was 1 mass ppm (fullerene residual ratio of 0.03). The abrasion resistance of the obtained lubricating oil composition was evaluated in the same manner as in Example 1. The diameter of the worn area was 190 μm. The results are summarized in Table 3.

TABLE 3

| | Composition of lubricating oil composition | | Treatment of producing FLN adduct | | | After irradiation treatment | | |
|---|---|---|---|---|---|---|---|---|
| | FLN concentration [mass ppm] | Base oil | Concentration [mass ppm] of dissolved oxygen | Irradiation conditions | Heating condition | FLN concentration [mass ppm] | FLN residual rate [—] | Diameter [um] of worn area |
| Example 7 | 30 | P46 | 2.2 | Ultraviolet light, 60 J/cm$^2$ × two times | None | 22 | 0.73 | 200 |
| Example 8 | 30 | P46 | 2.2 | Ultraviolet light, 60 J/cm$^2$ × seven times | None | 4 | 0.13 | 160 |
| Example 9 | 30 | P46 | 2.2 | Ultraviolet light, 60 J/cm$^2$ × nine times | None | 1 | 0.03 | 190 |

When comparing Example 1 with Examples 7 to 9, it was found that, in a case where the irradiation energy was constant, the abrasion resistance changed due to the change in the ultraviolet irradiation time. In addition, it was found that, if the ultraviolet irradiation time was within a moderate range, particularly favorable abrasion resistance was obtained. As a guideline, it is preferable to control the ultraviolet irradiation time so that the fullerene residual ratio is within a range of 0.1 to 0.7.

Example 10

A lubricating oil composition was obtained in the same manner as in Example 1 except that ultraviolet light having a shorter wavelength of 185 nm was emitted as a radiation source for 20 seconds two times using a low-pressure mercury UV lamp (manufactured by Sen Lights Co., Ltd., model UVL20PH-6) instead of the ultraviolet irradiation device. The fullerene solution placed in the four-neck eggplant flask was irradiated with ultraviolet light from outside of the four-neck eggplant flask. The concentration of the fullerenes in the fullerene solution after the ultraviolet irradiation was 22 mass ppm (fullerene residual ratio of 0.73). The abrasion resistance of the obtained lubricating oil composition was evaluated in the same manner as in Example 1. The diameter of the worn area was 190 μm. The results are summarized in Table 4.

Example 11

A lubricating oil composition was obtained in the same manner as in Example 1 except that an X-ray (wavelength of 10 nm or less) which was ionizing radiation was emitted as a radiation source for 480 seconds using an X-ray irradiation device (manufactured by Toreck Co., Ltd., RIX-250C-2) instead of the ultraviolet irradiation device. The fullerene solution placed in the four-neck eggplant flask was irradiated with an X-ray from outside of the four-neck eggplant flask. The concentration of the fullerenes in the fullerene solution after the X-ray irradiation was 22 mass ppm (fullerene residual ratio of 0.73). The abrasion resistance of the obtained lubricating oil composition was evaluated in the same manner as in Example 1. The diameter of the worn area was 195 μm. The results are summarized in Table 4.

TABLE 4

| | Composition of lubricating oil composition | | Treatment of producing FLN adduct | | | After irradiation treatment | | |
|---|---|---|---|---|---|---|---|---|
| | FLN concentration [mass ppm] | Base oil | Concentration [mass ppm] of dissolved oxygen | Irradiation conditions | Heating condition | FLN concentration [mass ppm] | FLN residual rate [—] | Diameter [um] of worn area |
| Example 10 | 30 | P46 | 2.2 | Ultraviolet light (having wavelength of 185 nm) | None | 22 | 0.73 | 190 |
| Example 11 | 30 | P46 | 2.2 | X-ray | None | 22 | 0.73 | 195 |

Comparing Example 1 with Examples 10 and 11, the abrasion resistance of Example 1 is better than that of Examples 10 and 11 in which ultraviolet light having a shorter wavelength or an X-ray is used. From this, radiation having low energy based on the wavelength is preferable as radiation used in the step of producing a lubricating oil composition as long as enough cleaved molecules can be produced.

However, comparing Comparative Example 3 with Examples 10 and 11, the lubricating oil compositions of Examples 10 and 11 in which an X-ray having higher energy based on the wavelength was used as a radiation source exhibited sufficiently high abrasion resistance compared to the lubricating oil composition of Comparative Example 3 in which no radiation was emitted. Since the abrasion resistance does not deteriorate even if radiation having high energy is emitted in this manner, it is thought that it is possible to realize excellent abrasion resistance even if the lubricating oil composition of the present embodiment is used in outer space, a reactor facility, or the like.

Example 12

A lubricating oil composition was obtained in the same manner as in Example 1 except that the concentration of the fullerenes in the fullerene solution before the ultraviolet irradiation was 90 mass ppm. The concentration of the fullerenes in the fullerene solution after the ultraviolet irradiation was 59 mass ppm (fullerene residual ratio of 0.66). The abrasion resistance of the obtained lubricating oil composition was evaluated in the same manner as in Example 1. The diameter of the worn area was 180 μm. The results are summarized in Table 5.

Example 13

A lubricating oil composition was obtained in the same manner as in Example 12 except that the concentration of the fullerenes in the fullerene solution before the ultraviolet irradiation was 250 mass ppm. The concentration of the fullerenes in the fullerene solution after the ultraviolet irradiation was 220 mass ppm (fullerene residual ratio of 0.88). The abrasion resistance of the obtained lubricating oil composition was evaluated in the same manner as in Example 1. The diameter of the worn area was 190 μm. The results are summarized in Table 5.

TABLE 5

| | Composition of lubricating oil composition | | Treatment of producing FLN adduct | | | After irradiation treatment | | |
|---|---|---|---|---|---|---|---|---|
| | FLN concentration [mass ppm] | Base oil | Concentration [mass ppm] of dissolved oxygen | Irradiation conditions | Heating conditions | FLN concentration [mass ppm] | FLN residual rate [—] | Diameter [um] of worn area |
| Example 12 | 90 | P46 | 2.2 | Ultraviolet light, 60 J/cm$^2$ × three times | None | 59 | 0.66 | 180 |
| Example 13 | 250 | P46 | 2.2 | Ultraviolet light, 60 J/cm$^2$ × three times | None | 220 | 0.88 | 190 |

Comparing Example 1 with Examples 12 and 13, even if the concentration of the fullerenes in the lubricating oil composition is high, the abrasion resistance exhibited is not significantly low. That is, even if the lubricating oil composition contains an excessive amount of fullerene, the effect on the abrasion resistance of the lubricating oil composition is small. Accordingly, in a case where the lubricating oil composition is used in a harsh environment where cleavage of the base oil is likely to occur, the concentration of the fullerenes in the fullerene solution can be increased within a range that does not affect the stability of the lubricating oil composition to capture more cleaved molecules thereof.

INDUSTRIAL APPLICABILITY

The lubricating oil composition of the present embodiment is suitable for various oils such as: industrial gear oil; hydraulic oil; compressor oil; refrigerator oil; cutting oil; plastic working oils such as rolling oil, pressing oil, forging oil, drawing oil, drawing oil, and punching oil; metal working oils such as heat treatment oil and electric discharge machining oil; sliding guide surface oil; bearing oil; rust-proof oil; and heat medium oil.

In addition, the lubricating oil composition of the present embodiment is useful for devices or equipment used in outer space or reactor facilities irradiated with radiation, and is significantly useful for long-term suppression of damage or abrasion of metal parts in sliding portions of devices or equipment mounted on spacecrafts, rockets, probes, space stations, satellites, and the like or in sliding portions of devices or equipment constituting reactor main bodies, reactor cooling system equipment, measurement control system equipment, fuel equipment, radiation control equipment, disposal equipment, reactor storage facilities, auxiliary boilers, and the like.

The invention claimed is:

1. A method for producing a lubricating oil composition, comprising:

an irradiation step of irradiating a fullerene solution in which fullerenes are dissolved in a base oil with radiation to produce fullerene adducts, wherein the radiation is ultraviolet light.

2. The method for producing a lubricating oil composition according to claim 1, further comprising:

a removal step of removing an insoluble component from the fullerene solution.

3. The method for producing a lubricating oil composition according to claim 1, wherein, in the irradiation step, the radiation is emitted in a non-oxidizing atmosphere.

4. The method for producing a lubricating oil composition according to claim 3, wherein the radiation is emitted while setting an oxygen gas concentration in the fullerene solution to 10 mass ppm or less.

5. The method for producing a lubricating oil composition according to claim 1, wherein the ultraviolet light has a wavelength of 190 nm to 365 nm.

6. The method for producing a lubricating oil composition according to claim 1, wherein the radiation is emitted until a ratio of a concentration of the fullerenes in the fullerene solution after the irradiation step to a concentration of the fullerenes in the fullerene solution before the irradiation step is 0.1 to 0.7.

7. The method for producing a lubricating oil composition according to claim 1, wherein the fullerenes include $C_{60}$ or $C_{70}$ or a mixture thereof.

8. The method for producing a lubricating oil composition according to claim 1, wherein, in the irradiation step, the radiation is emitted while controlling a temperature of the fullerene solution such that it is 40° C. to 200° C.

9. The method for producing a lubricating oil composition according to claim 1, wherein, in the irradiation step, the radiation is emitted 2 to 9 times.

10. The method for producing a lubricating oil composition according to claim 1, wherein, in the irradiation step, the fullerene solution is accommodated in a container, and wherein, in the irradiation step, the radiation is emitted from outside of the container.

11. The method for producing a lubricating oil composition according to claim 1, wherein, in the irradiation step, 1 g of the fullerene solution is irradiated with the radiation at an irradiation energy of 1 J to 100 J.

12. A lubricating oil composition comprising:

a base oil; and fullerene adducts, wherein added groups of the fullerene adducts have a part of a molecular structure constituting the base oil, and wherein the base oil is selected from a mineral oil, diesters, polyalkylene glycols, polyalkyl vinyl ether, polybutene, isoparaffin, olefin copolymers, alkylbenzene, alkylnaphthalene, diisodecyl adipate, monoesters, dibasic acid esters, tribasic acid esters, polyol esters, dialkyl diphenyl ethers, alkyl diphenyl sulfide, polyphenyl ethers, silicone lubricating oils, and perfluoropolyether.

13. The method for producing a lubricating oil composition according to claim 1, wherein the radiation is emitted until a ratio of a concentration of the fullerenes in the fullerene solution after the irradiation step to a concentration of the fullerenes in the fullerene solution before the irradiation step is 0.03 to 0.88.

14. The lubricating oil according to claim 12, wherein the base oil is a mineral oil.

15. The lubricating oil according to claim 12, wherein the base oil is a mineral oil selected from a paraffinic base oil and a naphthenic base oil.

16. The lubricating oil according to claim 12, wherein the base oil is selected from diesters, polyol esters, polyalkylene glycols, and polyalkyl vinyl ethers.

* * * * *